US012416126B2

(12) United States Patent
Sun et al.

(10) Patent No.: US 12,416,126 B2
(45) Date of Patent: Sep. 16, 2025

(54) RESERVOIR DESILTING DEVICE HAVING FUNNEL WITH BIVARIATE NORMAL SURFACE

(71) Applicant: Zhejiang University, Zhejiang (CN)

(72) Inventors: Zhilin Sun, Zhejiang (CN); Yizhi Sun, Zhejiang (CN); Chunhong Hu, Zhejiang (CN); Haolei Zheng, Zhejiang (CN); Yimeng Gao, Zhejiang (CN); Lixiao Sun, Zhejiang (CN)

(73) Assignee: Zhejiang University, Hangzhou (CN)

( * ) Notice: Subject to any disclaimer, the term of this patent is extended or adjusted under 35 U.S.C. 154(b) by 170 days.

(21) Appl. No.: 18/273,756

(22) PCT Filed: Feb. 1, 2021

(86) PCT No.: PCT/CN2021/074580
§ 371 (c)(1),
(2) Date: Jul. 21, 2023

(87) PCT Pub. No.: WO2022/160324
PCT Pub. Date: Aug. 4, 2022

(65) Prior Publication Data
US 2024/0110351 A1 Apr. 4, 2024

(51) Int. Cl.
*E02B 3/02* (2006.01)
*E02B 8/02* (2006.01)

(52) U.S. Cl.
CPC . *E02B 3/02* (2013.01); *E02B 8/02* (2013.01)

(58) Field of Classification Search
CPC .... E02B 3/02; E02B 3/023; E02B 8/02; E02F 3/9243; F03B 17/06; F04F 5/10
See application file for complete search history.

(56) References Cited

U.S. PATENT DOCUMENTS 4,614,458 A * 9/1986 Austin ..... E02B 3/023 405/52
4,902,430 A * 2/1990 Peterson ..... E02B 3/023 405/74
D567,038 S * 4/2008 Carallo ..... D7/700
D773,544 S * 12/2016 Tseng ..... D15/150

FOREIGN PATENT DOCUMENTS

CN 105951664 A * 9/2016 ..... E02B 3/023
KR 101446875 B1 * 11/2014

* cited by examiner

*Primary Examiner* — Kyle Armstrong
(74) *Attorney, Agent, or Firm* — CM Law PLLC; Robert C. Klinger

(57) ABSTRACT

The present disclosure provides a reservoir desilting device having a funnel with a bivariate normal surface, which belongs to the technical field of water conservancy projects. The device includes a sediment inlet funnel and a sediment transport pipeline, where the sediment inlet funnel is located in a sediment accumulation area in a reservoir, the sediment transport pipeline is laid on a river bed of the reservoir, a bottom of the sediment inlet funnel is connected to one end of the sediment transport pipeline, and the other end of the sediment transport pipeline penetrates out of a bottom of a dam; and the sediment transport funnel has a shape of a bivariate normal surface, the sediment transport pipeline has a shape of an inverse hyperbolic geodesic curve, and the sediment transport pipeline is provided with a valve.

2 Claims, 1 Drawing Sheet

RESERVOIR DESILTING DEVICE HAVING FUNNEL WITH BIVARIATE NORMAL SURFACE

CROSS-REFERENCE TO RELATED APPLICATION

This patent application is a national stage application of International Patent Application No. PCT/CN2023/074580, filed on Feb. 1, 2021, the disclosure of which is incorporated by reference herein in its entirety as part of the present application.

TECHNICAL FIELD

The present disclosure belongs to the technical field of operation and management of water conservancy projects, and particularly relates to a reservoir desilting device having a funnel with a bivariate normal surface.

BACKGROUND

After a reservoir dam is built, sediment accumulation occurs in a reservoir area as the reservoir stores water. Sediment accumulation in a reservoir reduces the capacity of the reservoir and affects navigation in the reservoir area, resulting in a reduction in comprehensive benefits of the reservoir. Therefore, the sediment accumulation problem is to be urgently solved in water conservancy projects.

As an important part of the solution to the accumulation of the reservoir, reservoir desilting has great practical significance. Desilting bottom holes are currently used to drain silt in front of the dam. A desilting bottom hole is normally arranged in the lower part of a dam inlet. A water flow in front of the dam gathers to the port of the hole after the bottom hole gate is opened, liable to form a funnel-shaped scouring pit caused by local scouring of a river bed, which is customarily called a scouring funnel in engineering. Since the shape and size of the scouring funnel can hardly be controlled and the area is small, a desired effect of desilting cannot be achieved accordingly.

SUMMARY

An objective of the present disclosure is to provide a reservoir desilting device having a bivariate normal distribution funnel for defects in the prior art.

In order to achieve the above objective, the present disclosure employs the following technical solution: a reservoir desilting device having a funnel with a bivariate normal surface includes a sediment inlet funnel and a sediment transport pipeline, where the sediment inlet funnel is located in a sediment accumulation area in a reservoir, the sediment transport pipeline is laid on a river bed of the reservoir, a bottom of the sediment inlet funnel is connected to one end of the sediment transport pipeline, and the other end of the sediment transport pipeline penetrates a bottom of a dam; the sediment inlet funnel has a shape of a bivariate normal surface, the sediment transport pipeline has a shape of an inverse hyperbolic geodesic curve, and the sediment transport pipeline has a valve installed.

Further, the axis of the sediment inlet funnel points upwards along the water depth in a forward direction of a z axis. A forward direction of the x axis is the direction of the water flow, and a forward direction of a y axis is departing from the shore. The sediment inlet funnel has the shape satisfying:

$$z = f(x, y) = \frac{-k}{2\pi\sigma_x\sigma_y}\exp\left[-\left(\frac{x^2}{2\sigma_x^2} + \frac{y^2}{2\sigma_y^2}\right)\right]$$

where $\sigma_x$ is the standard deviation in the x direction, $\sigma_y$ is the standard deviation in the y direction, and k is the correction factor.

Further and separately, the sediment transport pipeline has a forward direction of the y axis upwards along the water depth, and a forward direction of the x axis in the direction of the water flow. The sediment transport pipeline has the shape satisfying:

$$y = f(x) = -\tanh^{-1}x = -\frac{1}{2}\ln\frac{1+x}{1-x}.$$

Compared with the prior art, the present disclosure has the following beneficial effects: a bivariate normal surface is used for the design of the sediment inlet funnel so that the funnel surface is smooth everywhere and the sediment is less likely to be accumulated during desilting, which effectively prevents the sediment inlet from clogging. The sediment transport pipeline with an inverse hyperbolic geodesic curve has a surface smooth everywhere, and the inlet and the outlet are consistent with the direction of gravity to strengthen the siphon effect, such that a water flow carrying sediment may pass through the dam and be discharged smoothly. The combination of the two may significantly improve the efficiency of desilting and help to solve the problem of sediment accumulation in the reservoir.

DETAILED DESCRIPTION OF THE EMBODIMENTS

The present disclosure will be further described below with reference to the accompanying drawings.

Figure 1:
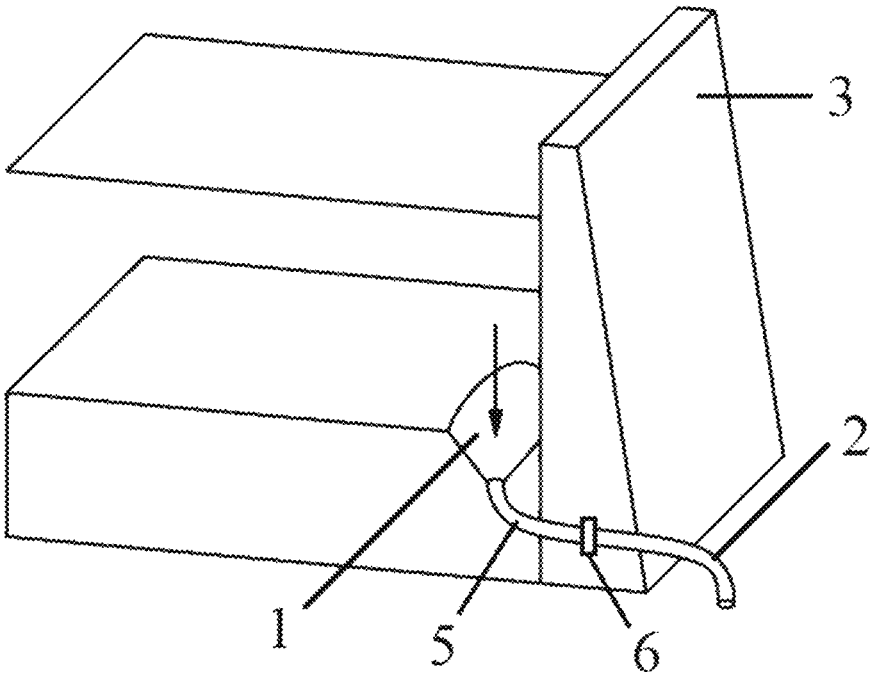
FIG. 1 is an entire longitudinal sectional view of a reservoir desilting device having a bivariate normal distribution funnel with a surface according to the present disclosure.

FIG. 1 is a sectional view of a reservoir desilting device having a funnel with a bivariate normal surface according to the present disclosure. The reservoir desilting device includes a sediment inlet funnel 1 and a sediment transport pipeline 2, where the sediment inlet funnel 1 is located in a sediment accumulation area in a reservoir, the sediment transport pipeline 2 is laid on a river bed of the reservoir, a bottom of the sediment inlet funnel 1 is connected to one end of the sediment transport pipeline 2, and the other end of the sediment transport pipeline 2 penetrates out of a bottom of a dam 3. The sediment transport pipeline 2 has a shape of an inverse hyperbolic geodesic curve 5. The sediment transport pipeline 2 has a forward direction of a y axis in a water depth upwards, and a forward direction of an x axis in a water flow direction. The sediment transport pipeline 2 has the shape satisfying:

$$y = f(x) = -\tanh^{-1}x = -\frac{1}{2}\ln\frac{1+x}{1-x}$$

The sediment transport pipeline 2 has the shape of the inverse hyperbolic geodesic curve 5 and has a surface smooth everywhere. An inlet and an outlet are consistent with a direction of gravity, and a middle is inclined horizontally, such that a water flow carrying sediment may pass through a dam 3 and be discharged smoothly, which improves the efficiency of desilting.

Figure 2:
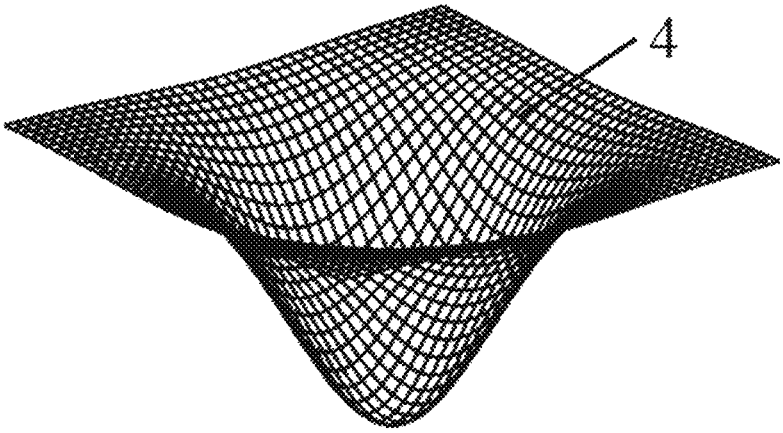
FIG. 2 is a bivariate normal surface diagram.

The sediment inlet funnel 1 has a shape of a bivariate normal surface 4. As shown in FIG. 2, the shape satisfies a bivariate normal surface equation established by taking a water depth upward as a forward direction of a z-axis, a water flow direction as a forward direction of an x axis, and a direction away from a shore as a forward direction of a y axis.

$$z = f(x, y) = \frac{-k}{2\pi\sigma_x\sigma_y}\exp\left[-\left(\frac{x^2}{2\sigma_x^2} + \frac{y^2}{2\sigma_y^2}\right)\right]$$

$\sigma_x$ is a standard deviation in an x direction, $\sigma_y$ is a standard deviation in a y direction, and k is a correction factor. Since a surface of the bivariate normal surface 4 is smooth everywhere, the sediment inlet funnel 1 with the shape is not prone to accumulation during desilting, which may effectively prevent the sediment inlet from clogging.

When the reservoir desilting device having a funnel with a bivariate normal surface 4 according to the present disclosure is in operation, the valve 6 on the sediment transport pipeline is opened. Under the action of water pressure in the reservoir, a water flow carries sediment to be discharged into the reservoir downstream through and the sediment inlet funnel and a desilting pipeline.

What is claimed is:

1. A reservoir desilting device, comprising a sediment inlet funnel and a sediment transport pipeline, wherein the sediment inlet funnel is located in a sediment accumulation area in a reservoir, the sediment transport pipeline is laid on a river bed of the reservoir, the bottom of the sediment inlet funnel is connected to one end of the sediment transport pipeline, and the other end of the sediment transport pipeline penetrates a bottom of a dam; and the sediment inlet funnel has the shape of a bivariate normal surface, the sediment transport pipeline has the shape of an inverse hyperbolic geodesic curve, and the sediment transport pipeline is provided with a valve;

wherein the sediment inlet funnel has a forward direction of a z axis upwards along a water depth upwards, a forward direction of an x axis in a water flow direction, and a forward direction of a y axis departing from a shore, and the sediment inlet funnel has the shape satisfying:

$$z = f(x, y) = \frac{-k}{2\pi\sigma_x\sigma_y}\exp\left[-\left(\frac{x^2}{2\sigma_x^2} + \frac{y^2}{2\sigma_y^2}\right)\right]$$

wherein $\sigma_x$ is a standard deviation in an x direction, $\sigma_y$ is a standard deviation in a y direction, and k is a correction factor.

2. The reservoir desilting device according to claim 1, wherein the sediment transport pipeline has a forward direction of a y axis upwards along a water depth, and a forward direction of a x axis in a water flow direction, and the sediment transport pipeline has the shape satisfying:

$$y = f(x) = -\tanh^{-1}x = -\frac{1}{2}\ln\frac{1+x}{1-x}.$$

* * * * *